US011247826B2

(12) United States Patent
Chesworth

(10) Patent No.: US 11,247,826 B2
(45) Date of Patent: Feb. 15, 2022

(54) WRAP AROUND CONTAINER

(71) Applicant: PACKAGING ONE LIMITED, Middlewich (GB)

(72) Inventor: Ian Neil Chesworth, Northwich (GB)

(73) Assignee: PACKAGING ONE LIMITED, Middlewich (GB)

( * ) Notice: Subject to any disclaimer, the term of this patent is extended or adjusted under 35 U.S.C. 154(b) by 372 days.

(21) Appl. No.: 16/184,656

(22) Filed: Nov. 8, 2018

(65) Prior Publication Data

US 2019/0077566 A1 Mar. 14, 2019

Related U.S. Application Data

(62) Division of application No. 14/768,946, filed as application No. PCT/GB2014/050499 on Feb. 20, 2014, now Pat. No. 10,155,616.

(30) Foreign Application Priority Data

Feb. 20, 2013 (GB) ..... 1303009

(51) Int. Cl.
*B65D 81/03* (2006.01)
*B65D 81/127* (2006.01)
(Continued)

(52) U.S. Cl.
CPC ..... *B65D 81/03* (2013.01); *B65D 5/0245* (2013.01); *B65D 5/0281* (2013.01);
(Continued)

(58) Field of Classification Search
CPC .... B65D 81/03; B65D 5/0281; B65D 5/4266; B65D 81/1275; B65D 5/0245;
(Continued)

(56) References Cited

U.S. PATENT DOCUMENTS 607,572 A * 7/1898 Petts ..... B65D 75/14 229/87.15
2,071,232 A * 2/1937 Langehennig ..... B65D 75/28 229/87.01
(Continued)

FOREIGN PATENT DOCUMENTS

EP 0 377 375 B1 4/1992
GB 2 441 997 B 3/2008
(Continued)

OTHER PUBLICATIONS

GB1403011.8 Search Report Under Section 17.
(Continued)

*Primary Examiner* — J. Gregory Pickett
*Assistant Examiner* — Jenine Pagan
(74) *Attorney, Agent, or Firm* — Fay Sharpe LLP

(57) ABSTRACT

A wrap around container for holding an electronic device has a substantially rectangular panel comprising a device receiving portion at one end of the panel, a fixing portion at the opposite end of the panel, and a wrap around portion in between. A pair of flaps extend from opposite sides of the device receiving portion of the panel, each side being on a respective longitudinal edge of the rectangular panel. Each flap is arranged to be folded into a closed position where the flap is over at least a part of the device receiving portion and an upper surface of a device when placed on the device receiving portion. The wrap around portion is arranged to wrap at least over the flaps in the closed position and the fixing portion is arranged to be fixed to an outside of the container after wrapping of the wrap around portion to close the container. Foam means extend over at least part of the device receiving portion and onto the surface of each flap facing the device receiving portion when in the closed position so as to form a foam barrier between a device placed on the device receiving portion and the device
(Continued)

receiving portion and the closed flaps. The foam means are attached to the device receiving portion and the two flaps and the foam means is configured to be peelable away from the container when the container is open.

12 Claims, 14 Drawing Sheets

(51) Int. Cl.
*B65D 5/02* (2006.01)
*B65D 5/50* (2006.01)
*B65D 5/42* (2006.01)

(52) U.S. Cl.
CPC ..... *B65D 5/4266* (2013.01); *B65D 5/509* (2013.01); *B65D 5/5028* (2013.01); *B65D 81/1275* (2013.01); *B65D 2585/6837* (2013.01)

(58) Field of Classification Search
CPC ..... B65D 5/5028; B65D 5/509; B65D 2585/6837; B65D 75/14; B65D 81/127; B65D 85/30; B65D 81/025
USPC ..... 206/320; 229/87.02, 87.18, 103.2
See application file for complete search history.

(56) References Cited

U.S. PATENT DOCUMENTS 2,144,071 A 1/1939 Loth
3,217,868 A 11/1965 Champlin et al.
3,253,770 A 5/1966 Black
3,266,705 A * 8/1966 Wood ..... B65D 81/1275 206/523
3,303,603 A 2/1967 Abeson
3,445,051 A * 5/1969 Goldman ..... B65D 81/1275 206/521
3,516,593 A 6/1970 Larsen
3,666,166 A 5/1972 Freakes
4,083,454 A * 4/1978 O'Neill ..... B65D 5/0281 229/121
4,300,679 A 11/1981 Benzschawel et al.
4,589,552 A * 5/1986 Chevalier ..... B65D 75/14 206/784
4,627,223 A * 12/1986 Janhonen ..... B65D 75/38 53/449
4,773,534 A * 9/1988 DeHeras ..... H05K 9/0067 206/522
5,197,260 A 3/1993 Chevalier et al.
5,248,034 A * 9/1993 Janhonen ..... B65D 5/0245 206/424
5,477,965 A * 12/1995 Herbeck ..... A45C 7/0095 150/154
5,954,202 A * 9/1999 Mellon ..... B65D 75/14 206/462
6,443,309 B1 * 9/2002 Becker ..... B65D 5/60 206/594
6,471,118 B1 10/2002 Chevalier
6,530,480 B1 3/2003 Hardy
6,871,739 B2 3/2005 Lopez
7,621,404 B2 * 11/2009 Murray ..... B65B 25/001 206/594
8,281,970 B2 10/2012 Demskey
8,322,532 B2 12/2012 Schafer et al.
8,567,578 B2 10/2013 Cuong et al.
9,210,976 B2 * 12/2015 Maeda ..... A45C 7/0054
10,155,616 B2 * 12/2018 Chesworth ..... B65D 81/1275
2002/0130166 A1 * 9/2002 Goebel ..... B65D 5/0245 229/103.2
2003/0057128 A1 3/2003 Hardy
2004/0004111 A1 1/2004 Cardinale
2007/0095711 A1 5/2007 Thompson et al.
2008/0290144 A1 * 11/2008 Makofsky ..... B65D 81/107 229/68.1
2009/0229936 A1 9/2009 Cuong et al.
2013/0270133 A1 10/2013 Kenner et al.

FOREIGN PATENT DOCUMENTS

WO WO 88/07476 10/1988
WO WO 2010/025751 A1 3/2010

OTHER PUBLICATIONS

PCT/GB2014/050499 International Search Report and Written Opinion.
http://ad-emea.doubleclick.net/N3847/adi/ebay.uk.x.vip/_default;cat_19278;tcat_125 . . . , p. 1, Jan. 31, 2014.
http://www.biopack.be/Lid-En/Classical_Packaging/1-1149/Foam_posta_boxes , p. 1, Jan. 31, 2014.
http://www.colompac.com/details.php?gr=25, pp. 1-2, Feb. 4, 2014.
http://www.davpack.co.uk/blog/a-moment-please-for-foam-lined-boxes-and-clear-polythene-bags, pp. 1-2, Feb. 2, 2014.
http://fantasy.packagingdelivery.co.uk/products, cardboard-boxes-and-sheets/book-wr . . . , p. 1, Jan. 31, 2014.
http://www.fotofriend.com/why-choose-us. pp. 1-3, Feb. 4, 2014.
http://www.packaging2buy.co.uk/postal-boxes-foam-lined-boxes.html, pp. 1-2, Feb. 4, 2014.
http://www.packaging2buy.co.uk/white-postal-boxes.html, pp. 1-2, Feb. 4, 2014.
http://www.picturemaster.co.uk/land_canvas_accessary.html, pp. 1-3, Jan. 31, 2014.
http://www.postpack.co.uk/acatalog/brown-foam-wrap-4.html, p. 1, Feb. 4, 2014.
http://www.priorydirect.co.uk/colompac-instant-bottom-boxes.html, pp. 1-2, Feb. 4, 2014.
http://www.rajapack.co.uk/cardboard-boxes/postal-boxes/brown-foam-postal-boxes, p. 1, Feb. 4, 2014.
http://www.sapphirepackaging.com/site/index.php/boxes/postal-boxes, pp. 1-2, Feb. 4, 2014.
http://www.staples.co.uk/search/mailing+foam+lines_box, pp. 1-2, Feb. 4, 2014.
http://ukpackaging.com/cardboard-boxes/postal-boxes/pip-large-letter-postal-box, p. 1, Feb. 4, 2014.
http://ukpackaging.com/cardboard-boxes/postal-boxes/cd-dvd-mailers , p. 1, Feb. 4, 2014.
http://priorydirect.co.uk/colompac-moduleboxes , p. 1, Feb. 4, 2014.

* cited by examiner

WRAP AROUND CONTAINER

This divisional application claims the priority benefit of U.S. application Ser. No. 14/768,946, filed Aug. 19, 2015, which is a 371 filing of International Application No. PCT/GB2014/050499, filed Feb. 20, 2014, the entire disclosures of which are incorporated herein by reference.

BACKGROUND

The present invention relates to a wrap around container for holding an electronic device such as smart phones, hand-held tablet PCs, HDDs, optical drives and LCD screens whilst in transit, for example by mail or courier service.

An existing wrap around container for holding a product, such as a DVD, which is to be mailed is disclosed in GB 2441997. The container is made from corrugated cardboard and comprises a base panel separated by a lateral fold line from a wrap around panel. The end of the wrap around panel distal from the base panel is connected to a securing flap by a tear strip. A pair of side wall flaps extend from opposite sides of the base panel, and each flap is arranged to be folded over an upper surface of a product placed on the base panel. The wrap around panel is then wrapped over the flaps and underneath the base panel, the securing flap being fixed to the underside of the base panel by adhesive.

A problem with this wrap around container is that it is not suitable for transporting electronic devices such as smart phones and hand-held tablet PCs as the corrugated cardboard provides insufficient protection to the device from impact to the container.

BRIEF DESCRIPTION

It is an object of the present invention to provide a wrap around container that alleviates the above-mentioned problem.

According to the present invention there is provided a wrap around container for holding an electronic device, the container comprising:

- a substantially rectangular panel including a device receiving portion at one end of the panel, a fixing portion at the opposite end of the panel, and a wrap around portion in between;
- a pair of flaps extending from opposite sides of the device receiving portion of the panel, each side being on a respective longitudinal edge of the rectangular panel, and each flap being arranged to be folded into a closed position where the flap is over at least a part of the device receiving portion and an upper surface of a device when placed on the device receiving portion, the wrap around portion being arranged to wrap at least over the flaps in the closed position and the fixing portion being arranged to be fixed to an outside of the container after wrapping of the wrap around portion to close the container; and
- foam means extending over at least part of the device receiving portion and onto the surface of each flap facing the device receiving portion when in the closed position so as to form a foam barrier between a device placed on the device receiving portion and the device receiving portion and the closed flaps, the foam means being attached to the device receiving portion and/or at least one of the two flaps, the foam means being configured to be peelable away from the container when the container is open.

By having the foam means, the wrap around container can more readily protect an electronic device held within by absorbing shock from say the container being dropped or being moved suddenly. Since the foam means is peelable away from the container, the foam means can be easily separated or removed enabling the rectangular panel and the flaps of the container to be recycled separately from the foam means. All of the container can thus be recycled.

The container is arranged to tightly wrap around the device when the container is closed so that the device cannot move around in the container. The Royal Mail requires this when they are to transport lithium battery powered electronic devices. The wrap around container when closed around a tablet PC or smart phone would be of a sufficiently small size so that it can be posted as a large letter. The wrap around container may be used, for example, to hold a new electronic device or an electronic device that is being sent to or from repair.

The foam means may be attached to the container by double sided tape. Alternatively, the foam means may be attached to the container by an adhesive that enables it to be peeled away. Such an adhesive is used on letters on which new credit cards are attached.

The foam means may comprise a single foam member that extends over the device receiving portion and onto the surface of each flap facing the device receiving portion when in the closed position. This is suitable for transporting a smart phone.

The foam means may comprise a pair of foam members wherein each foam member extends over a part of the device receiving portion and onto the surface of each flap facing the device receiving portion when in the closed position. This arrangement is suitable for transporting an electronic device such as a tablet PC.

A gap or a second gap may be provided between facing distal ends of the foam members on the surface of each flap facing the device receiving portion when in the closed position.

Another gap or a first gap may be provided between facing ends of the foam members on the device receiving portion.

The gap and/or the another gap provide shock dissipation.

The foam means may include a foam strip that extends longitudinally over part of the surface of the wrap around portion facing the device receiving portion when folded over the flaps in the closed position, the foam strip being positioned to fit within the gap. The foam strip may extend in a longitudinal plane to form a further foam barrier, the further foam barrier being between opposite sides of a device held in the container and the wrap around portion when the container is closed. The foam strip may extend into said another gap. The foam strip thus provides a way of protecting opposite sides of the device which would not be protected by the foam member or members.

The foam means comprises a load bearing foam which may comprise closed cell foam. The foam means comprises a load bearing foam which may comprise an olefinic polymer. The foam means comprises a load bearing foam which may comprise a polyethylene foam.

The wrap around portion is preferably arranged to be wrapped under the device receiving portion, the fixing portion being arranged to be fixed to an outer surface of the wrap around portion above the flaps in the closed position to close the container. The fixing portion may comprise a flap arranged to be fixed to the outside of the container after wrapping of the wrap around portion to close the container and a severable strip between the fixing portion flap and the wrap around portion.

The wrap around portion may have a protrusion for being on the outside of each flap in the closed position. The protrusion can engage a side of the flap to provide additional strength to the flap in the closed position.

The substantially rectangular panel and the flaps of the wrap around container may comprise corrugated cardboard, the flutes of the corrugated cardboard of the panel and the flaps running laterally. The arrangement of panel and flaps of corrugated cardboard, and the foam means provide optimum cushioning for an electronic device held in the wrap around container. The foam means and corrugated cardboard provides a compression aid which widely spreads the load of other containers stacked above it. The foam means provides strength for stacking as it is load bearing. The containers can be stacked securely.

BRIEF DESCRIPTION OF THE DRAWINGS

Embodiments of the present invention will now be described, by way of example, with reference to the accompanying schematic drawings, in which.

DETAILED DESCRIPTION

Figure 1:
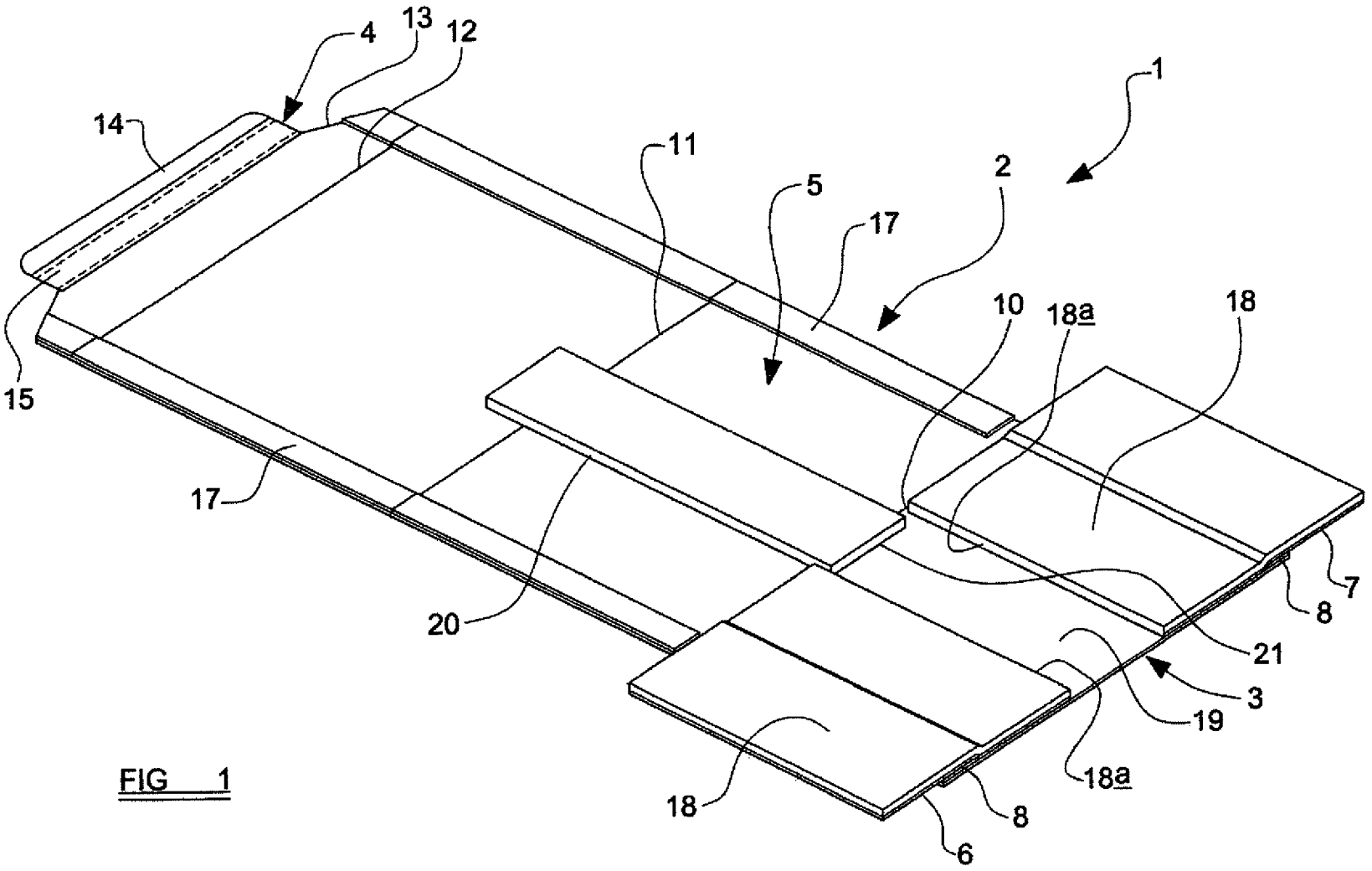
FIG. 1 is a perspective view of a wrap around container in an open state in accordance with a first embodiment of the present invention.

Referring to FIG. 1 of the accompanying drawings, a wrap around container or carton 1 according to a first embodiment of the invention comprises a substantially rectangular panel 2. The panel 2 comprises a device receiving portion 3 at one end of the panel 2, a fixing portion 4 at the opposite end of the panel 2, and a wrap around portion 5 in between. The container 1 also has a pair of flaps 6, 7. One end portion 8 (see also FIG. 2) of a major surface of each flap 6, 7 is fixed by adhesive to a major surface of the device receiving portion 3 adjacent to a respective longitudinal edge of the rectangular panel 2. Each flap 6, 7 is bent back on itself so that a distal end of the flap extends away from the other flap.

The wrap around portion 5 has a first lateral fold line 10 with the device receiving portion 3, a second lateral fold line 11 and a third lateral fold line 12 with a tapered part 13 of the wrap around portion 5. The tapered part 13 is initially of the same width as the rest of the wrap around portion 5 before it tapers to a shorter width where it is fixed to a fixing flap 14 of the fixing portion 4 by a severable strip 15 of the fixing portion 4. The fixing flap 14 has a self-adhesive sealing strip (not shown).

The wrap around portion 5 has a pair of longitudinal side strips 17 which are folded so as to produce double thickness edge strips and are held down by a strong adhesive. These edge strips 17 provide strengthened side impact protection.

Each flap 6, 7 is covered by a foam member 18 and the foam member 18 extends onto the major surface of the device receiving portion 3. There is a first gap 19 between facing ends 18*a* of the foam members 18. A foam strip 20 extends longitudinally between the first and second lateral fold lines 10, 11 and slightly beyond each fold line 10, 11, the portion 21 of the foam strip 20 which extends slightly beyond the first fold line 10 extending into the first gap 19 between the flap foam members 18. Each flap foam member 18 is attached to its respective flap 6, 7 and the device receiving portion 3, and the foam strip 20 is attached to the wrap around portion 5. This may be done by double sided adhesive tape (not shown).

Figure 2:
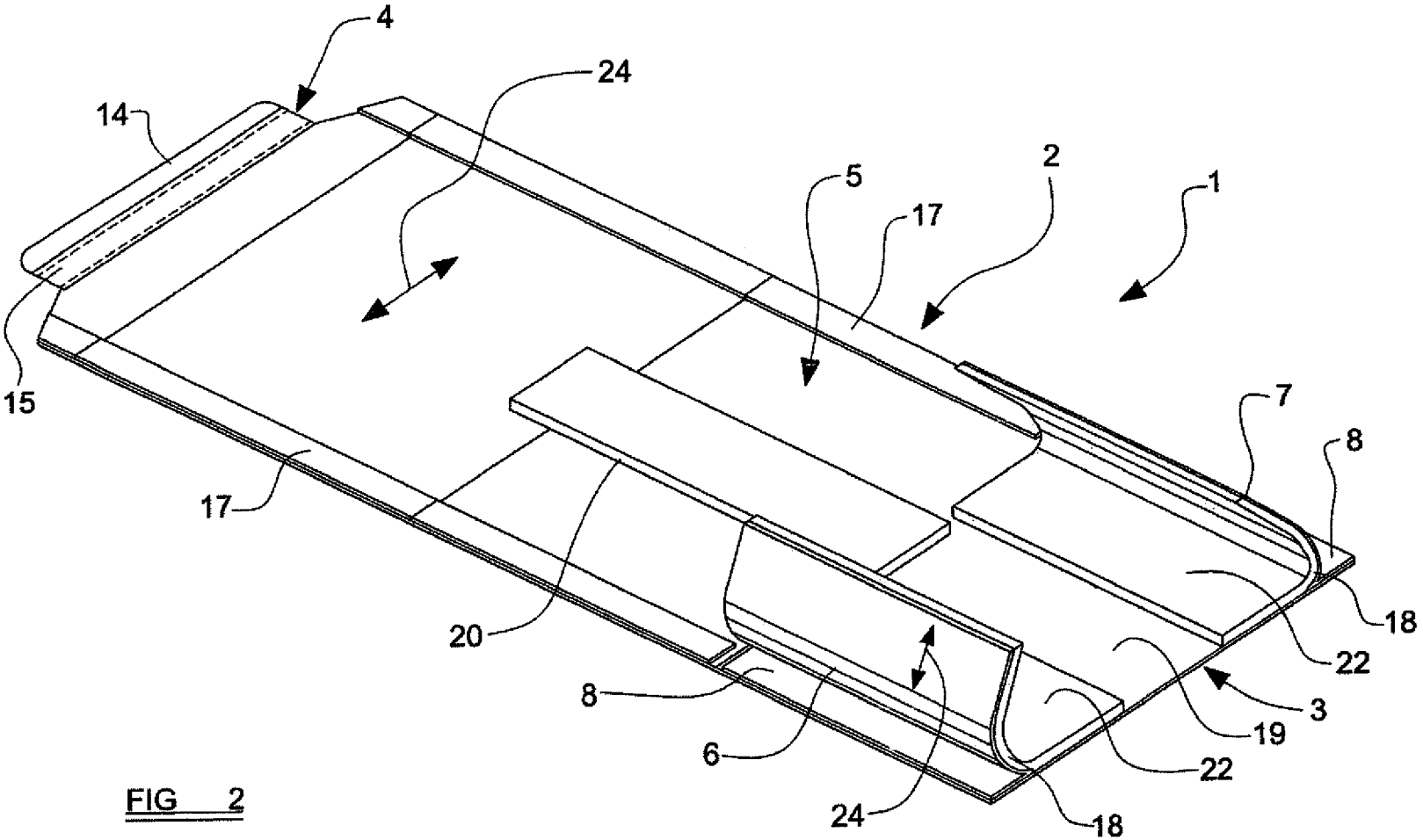
FIGS. 2 and 3 are perspective views of the wrap around container of FIG. 1 as it is being closed.
Figure 3:
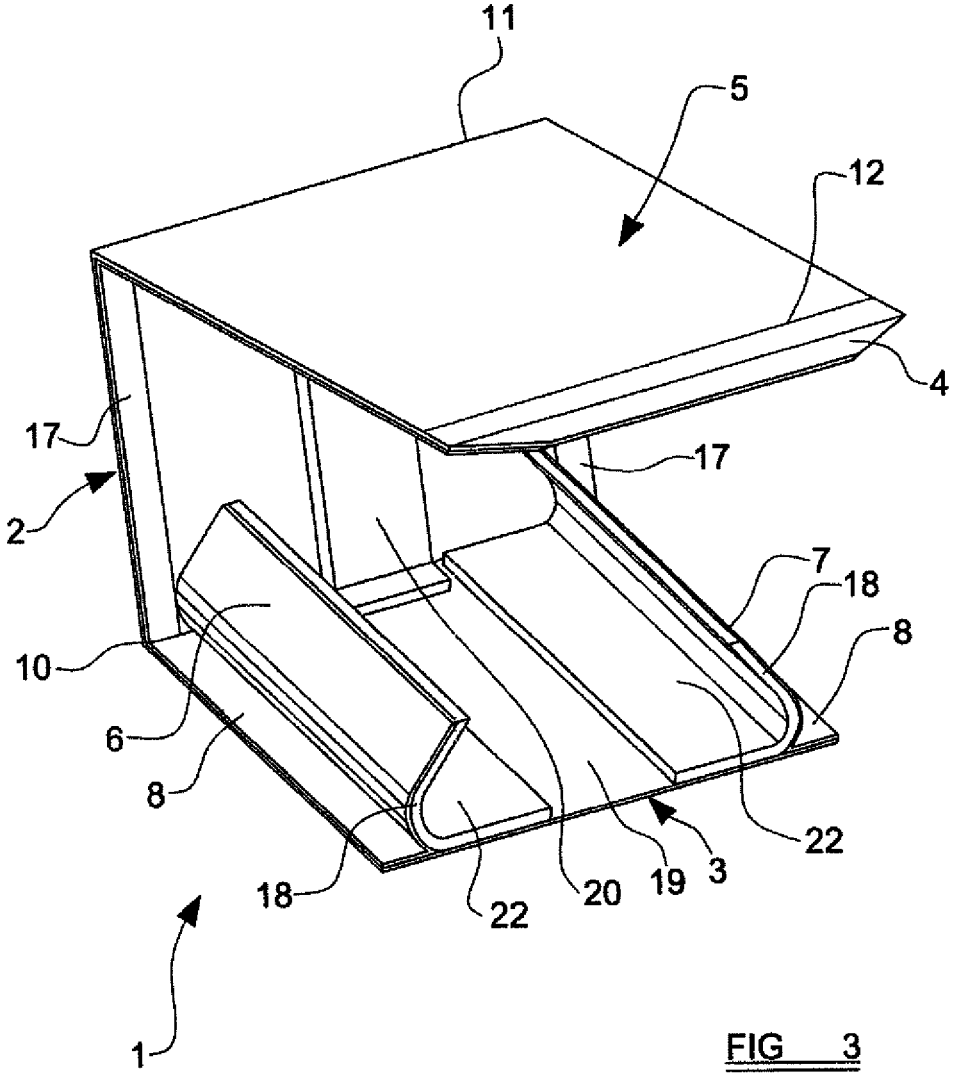

Referring to FIG. 2, an electronic device such as a tablet PC (not shown), which is substantially cuboid in shape, is placed on the device receiving portion 3. It rests on the end portion 22 of each foam member 18 that is adjacent the first gap 19 and spans the first gap 19 between the foam members 18. The two flaps 6, 7 are folded towards each other over the electronic device and in FIG. 3, the wrap around portion 5 is folded over the device receiving portion 3 and the flaps 6, 7.

Figure 4:
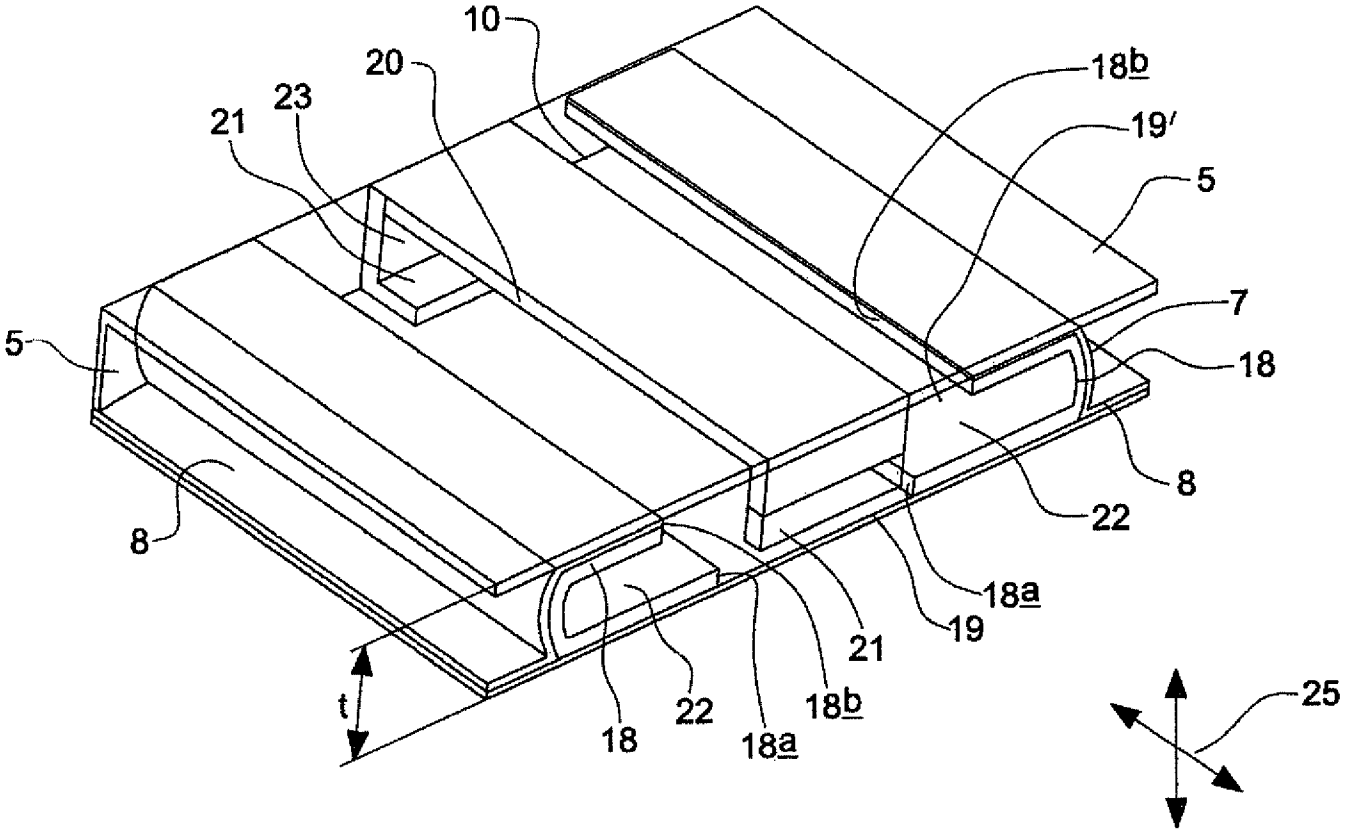
FIG. 4 is a perspective view of part of the wrap around container of FIG. 1 when the container is closed.
Figure 5:
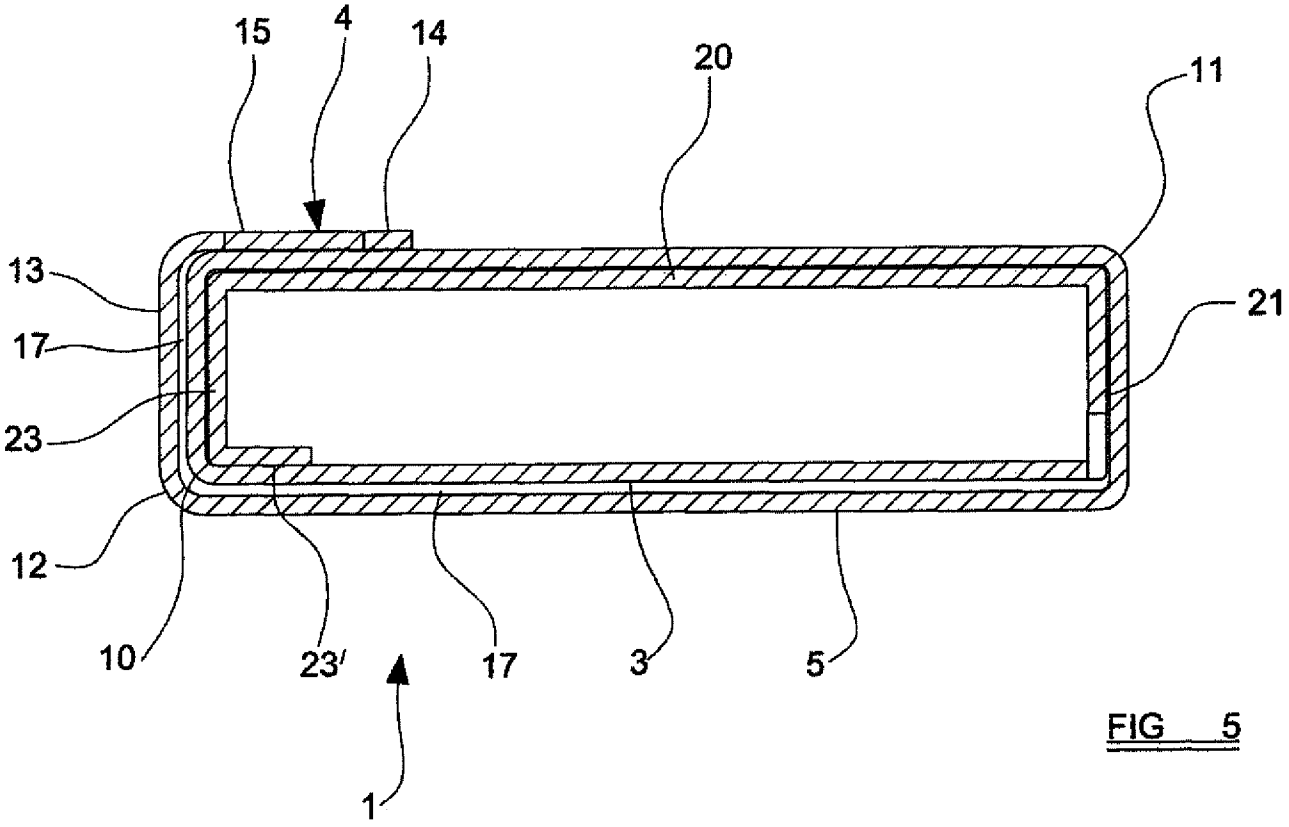
FIG. 5 is a longitudinal sectional view of the wrap around container of FIG. 1 when the container is closed.

Referring to FIGS. 4 and 5, the wrap around portion 5 is wrapped in a longitudinal direction. It is folded from the first fold line 10 up and over the folded flaps 6, 7 which are now in a closed position. Each foam member 18 thus extends over a part of the device receiving portion 3 and onto the surface of a respective flap 6, 7 facing the device receiving portion 3 and there is a second gap 19' between facing distal ends 18*b* of the foam members 18 on said flap surfaces. Each foam member 18 is also adjacent an upper surface of the electronic device placed on the device receiving portion 3. The foam strip 20 is on the surface of the wrap around portion 5 facing the device receiving portion 3 and fits within the second gap 19' between the two foam members 18. The first gap 19 provided between the foam members 18 provides shock dissipation. The gaps 19, 19' are aligned with each other.

The wrap around portion 5 is folded about the second fold line 11 and down and underneath the device receiving portion 3. The wrap around portion 5 is then folded about the third fold line 12 and the fixing portion 4 is over an outer surface of the wrap around portion 5 above the folded flaps 6, 7 with the fixing flap 14 being fixed to the wrap around portion 5 by adhesive which has been exposed by removing the self-adhesive sealing strip. The container 1 is thus secured tightly around the device and is closed. The foam members 18 form a foam barrier between the device and the device receiving portion 3 and the flaps 6, 7. Each foam member 18 has a C shape fit around the device. The end portion 21 of the foam strip 20 protects one side of the device and extends into the first gap 19 and the opposite end portion 23 protects the other or opposite side of the device. The foam strip 20 thus provides a further foam barrier and extends in a longitudinal plane 25 (see FIG. 4). The opposite end portion 23 includes the portion 21 that extends in the first gap 19 and underneath the device. The foam members 18 and foam strip 20 are strategically placed to protect the device in the container 1. They act as bumpers compressing and decompressing inside a closed container 1 to protect the device inside if the container 1 is, say, dropped or subjected to sudden movement.

To remove the device from the closed wrap around container 1 the severable strip 15 is ripped away and the wrap around container 1 is unwrapped. To dispose of the wrap around container 1 each flap foam member 8 is peeled away from its respective flap 6, 7 and the device receiving portion 3, and the foam strip 20 is peeled away from the wrap around portion 5 so that the foam and the rest of the container can be easily recycled.

The foam used for the foam members 18 and the foam strip 20 comprises an olefinic polymer such as polyethylene. This is stronger than a soft foam such as polyurethane. Also, if polyurethane foam was used it would be glued to the corrugated cardboard with a permanent adhesive and could therefore not be easily separated from the cardboard causing a problem for recycling.

The substantially rectangular panel 2 and the flaps 6, 7 comprise corrugated cardboard, the flutes of the corrugated cardboard of the panel and the flaps running laterally as indicated by arrow 24 on FIG. 2.

In a specific example of a preferred embodiment, the foam is a 28 kg/m$^3$ load bearing foam which is suitable for use with tablet PCs. The foam is preferably of a thickness of about 7 mm. When the wrap around container 1 is secured around a device it would have a thickness of about 30 to 38 mm, and the closed flaps 6, 7 would be a height t (see FIG. 4) of about 21 mm above the device receiving portion 3.

Figure 6:
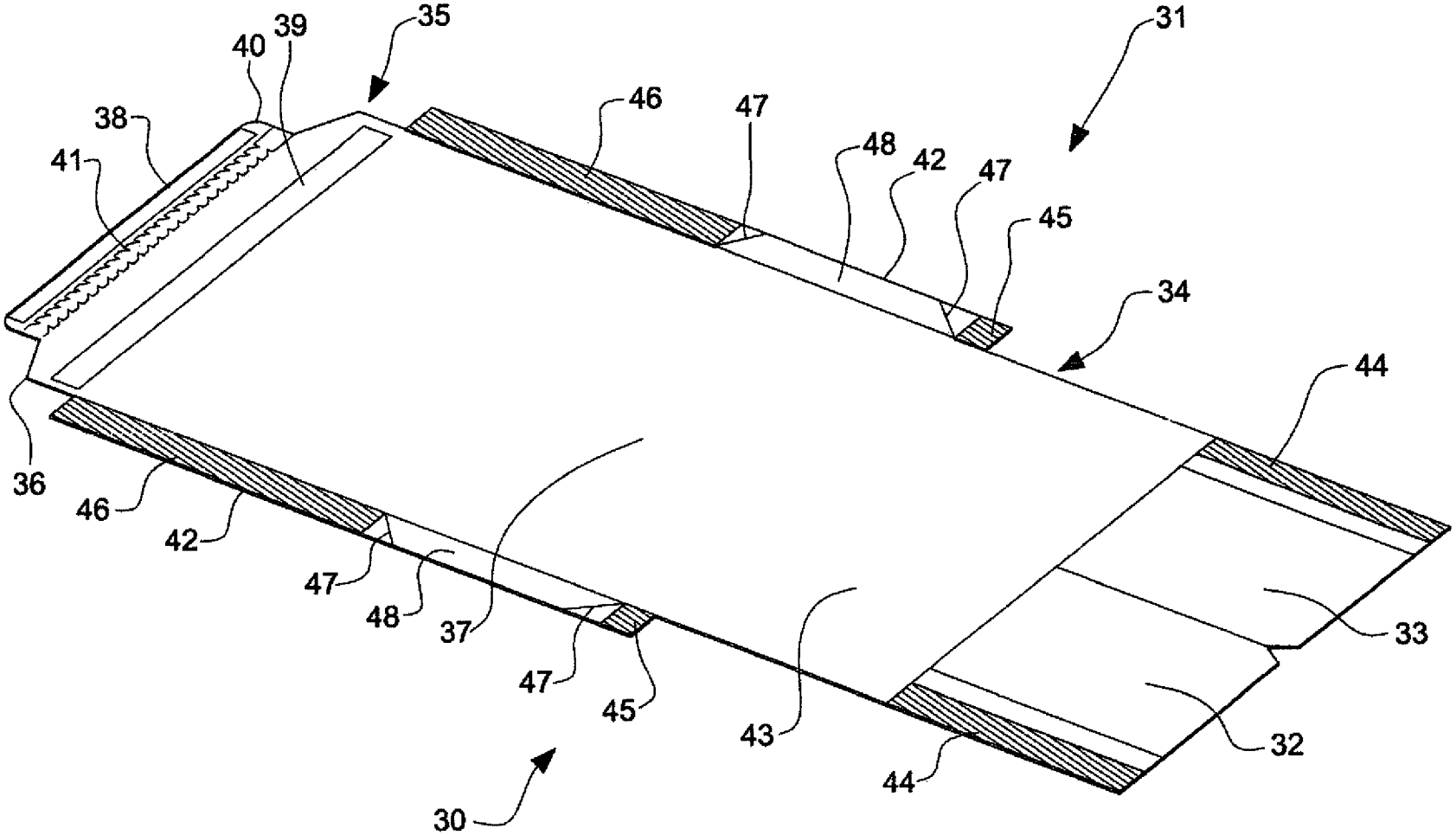
FIG. 6 is a perspective view of a blank forming part of a modified wrap around container.

Referring to FIG. 6, a blank 30 for forming part of a modified wrap around container 31 has a pair of flaps 32, 33 at one end of the substantially rectangular panel 34. The flaps 32, 33 are shown adjacent each other but they may be separated by a gap. The fixing portion 35 is at the opposite end of the panel 34. It includes the tapered portion 36 which is adjacent one end of the wrap around portion 37 of the rectangular panel 34. Unlike the tapered portion 13 illustrated in FIG. 1, there is no double thickness edge strip along the tapered portion 36 for the modified wrap around container 31. The fixing portion 35 also has a self-seal adhesive strip 38, 39 on the fixing flap 40 on one side of the severable strip 41 of the fixing portion 35 and on the tapered portion 36 on the other side of the severable strip 41. A longitudinal strip 42 is on each longitudinal side of the wrap around portion 37 of the panel 34 and there is no longitudinal strip on each longitudinal side of the device receiving portion 43 of the panel 34 which is between the wrap around portion 37 and the flaps 32, 33.

The end portion of each flap 32, 33 adjacent each respective longitudinal edge of the rectangular panel 34 has a strip of glue or adhesive 44 and the end portion is the only part of the flap connected to the device receiving portion 43 of the rectangular panel 34. Each longitudinal strip 42 has a square of glue 45 at the end adjacent the device receiving portion 43 and a strip of glue 46 at the opposite end. In between the square of glue 45 and the strip of glue 46, the longitudinal strip 42 is unglued and has a diagonal crease 47 extending across the width of the strip 42 from each corner of the unglued strip 48 adjacent the rectangular panel 34.

Figure 7:
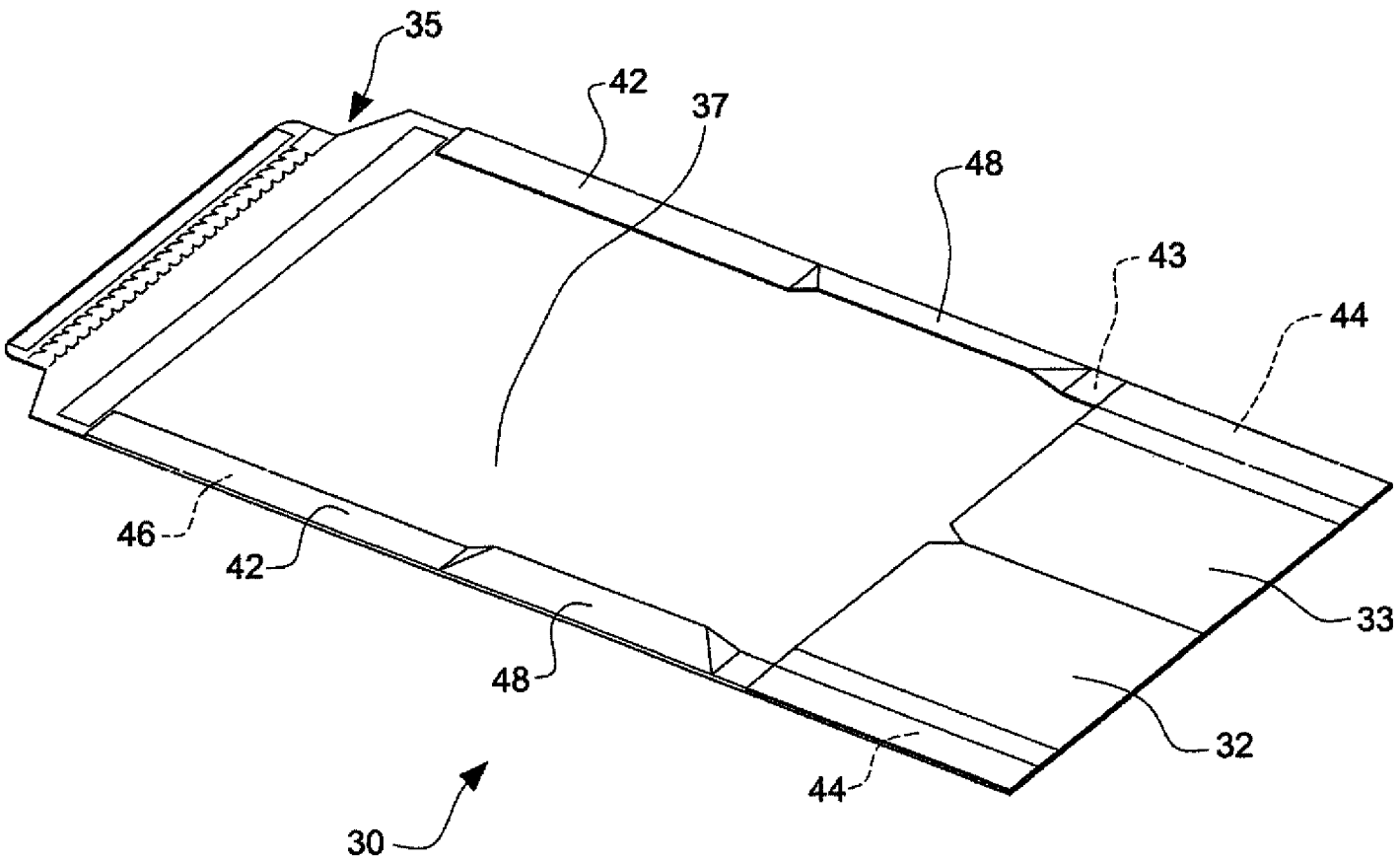
FIGS. 7 and 8 are perspective views of the blank of FIG. 6 in various stages of being folded.
Figure 8:
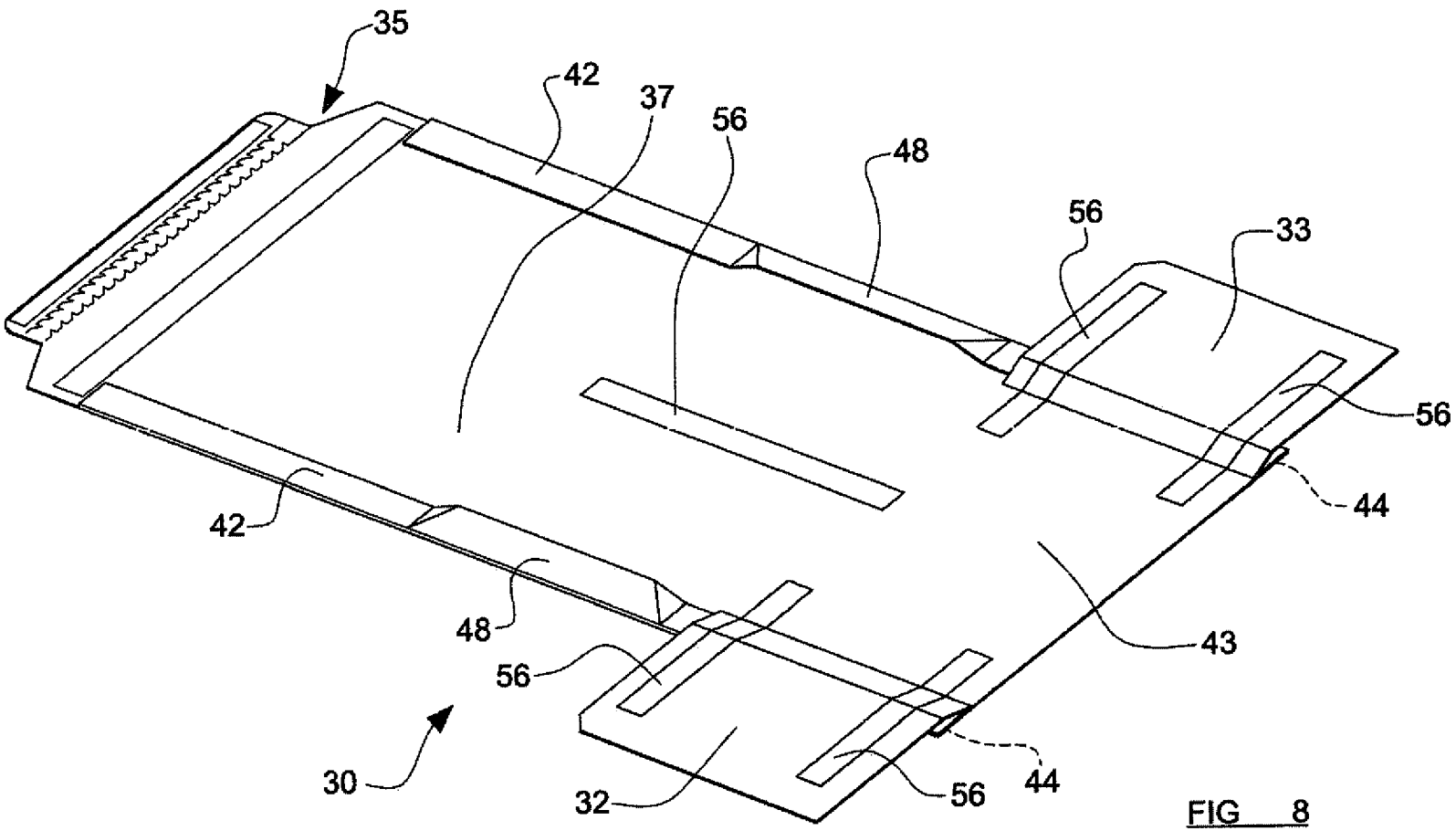
Figure 9:
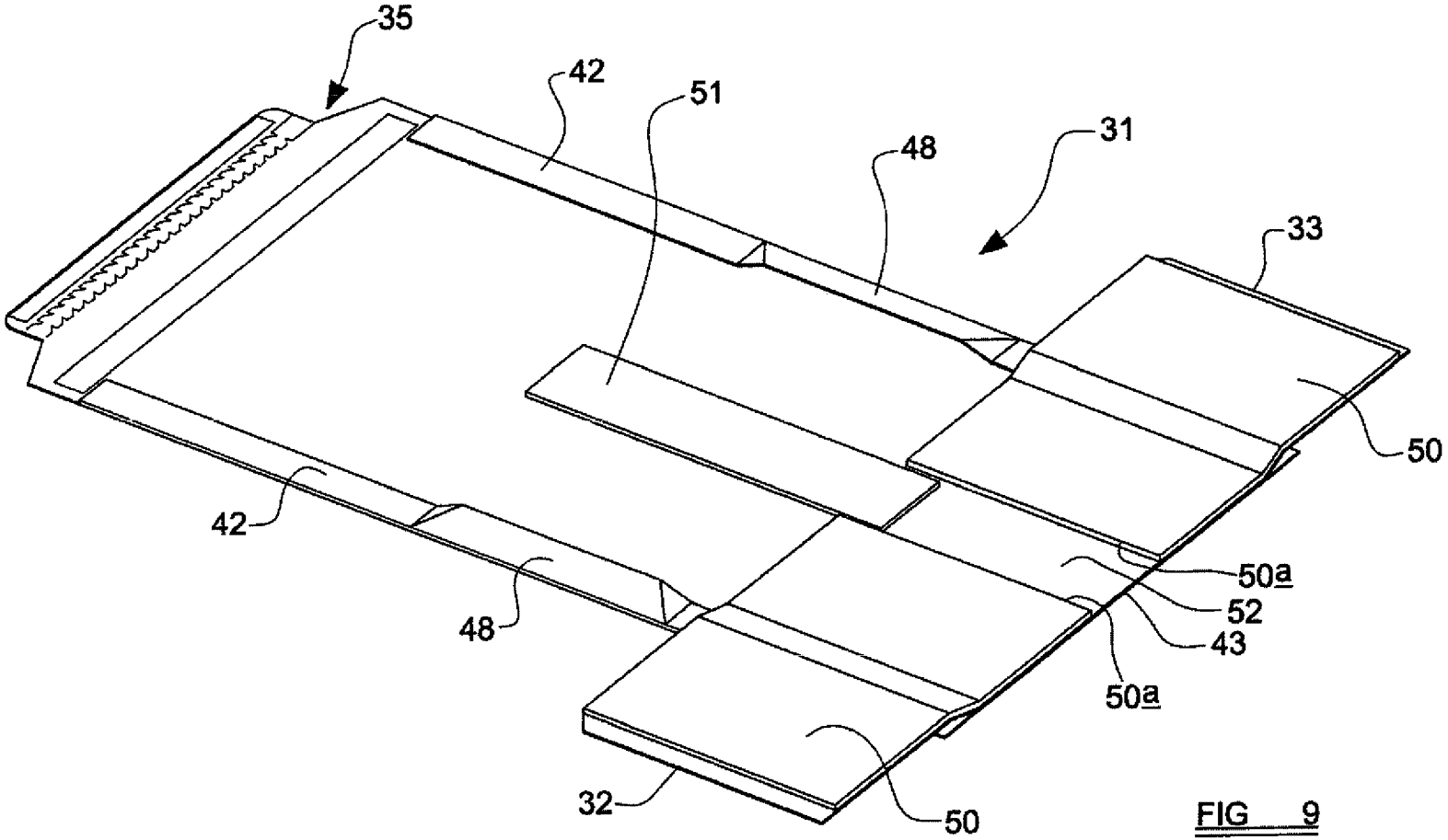
FIG. 9 is a perspective view of the modified wrap around container comprising the folded blank and foam members.

Referring to FIG. 7, each longitudinal strip 42 is folded onto the square of glue 45 and the strip of glue 46, and the unglued strip is lifted up from the rectangular panel 34 to form a locking crease 48. Each flap 32, 33 is folded onto the device receiving portion 43 and is held down to the device receiving portion 43 by the respective strip of glue 44. Each flap 32, 33 is then folded back over its end portion having the strip of glue 44 and away from each other (see FIG. 8). Each flap 32, 33 is covered by the foam member 50 (see FIG. 9) which also extends onto the major surface of the device receiving portion 43. Each foam member 50 is attached to its respective flap and the device receiving portion 43 by double sided tape 56 shown on FIG. 8. The foam strip 51 is on the wrap around portion 37 of the rectangular panel 34 and extends into the first gap 52 between facing ends 50*a* of the flap foam members 50. The foam strip 51 is attached to the wrap around portion 37 and the device receiving portion 43 by double sided tape 56 shown on FIG. 8.

Figure 10:
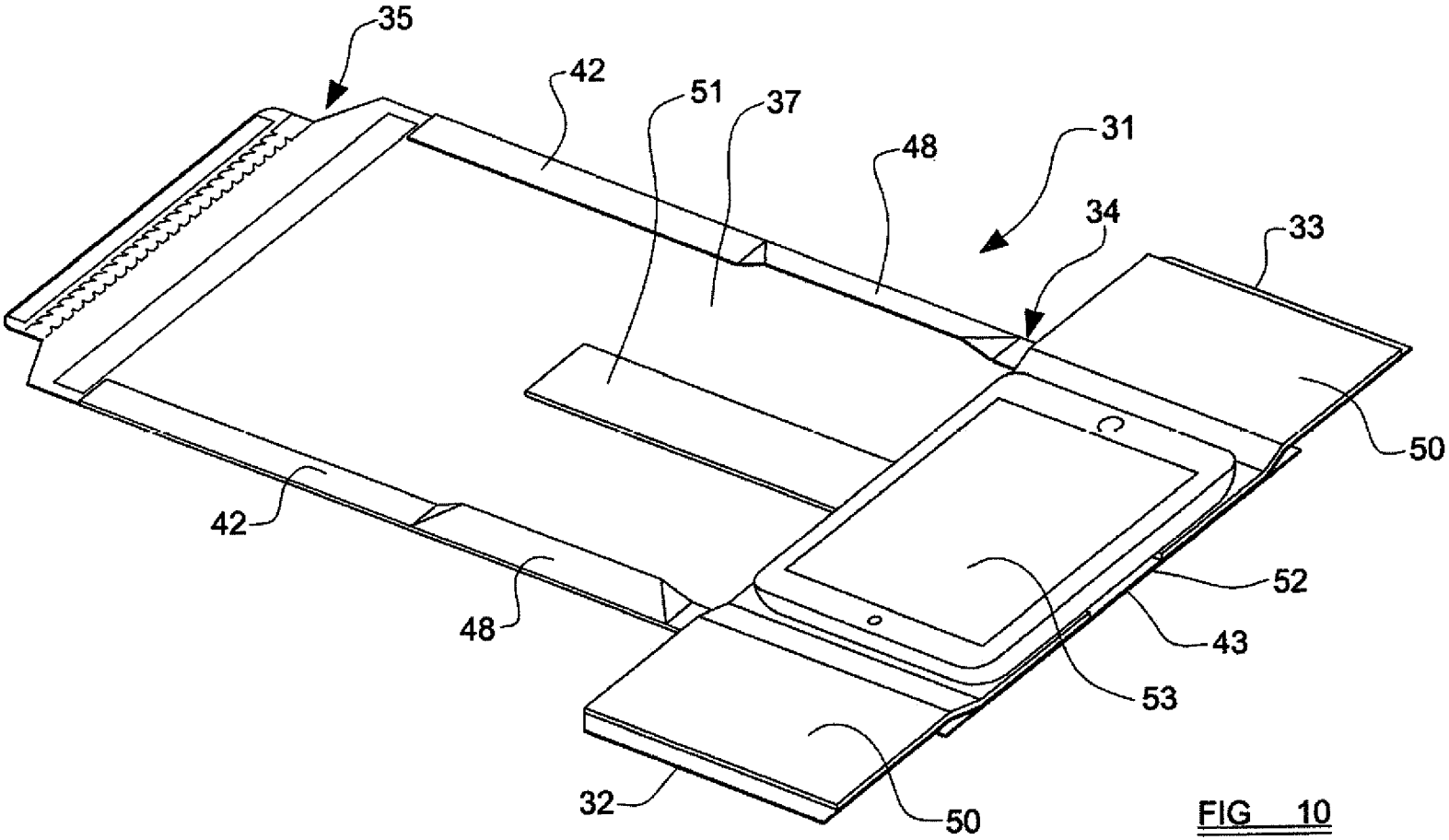
FIG. 10 is a perspective view of the wrap around container of FIG. 9 with a hand held tablet PC placed on it.
Figure 11:
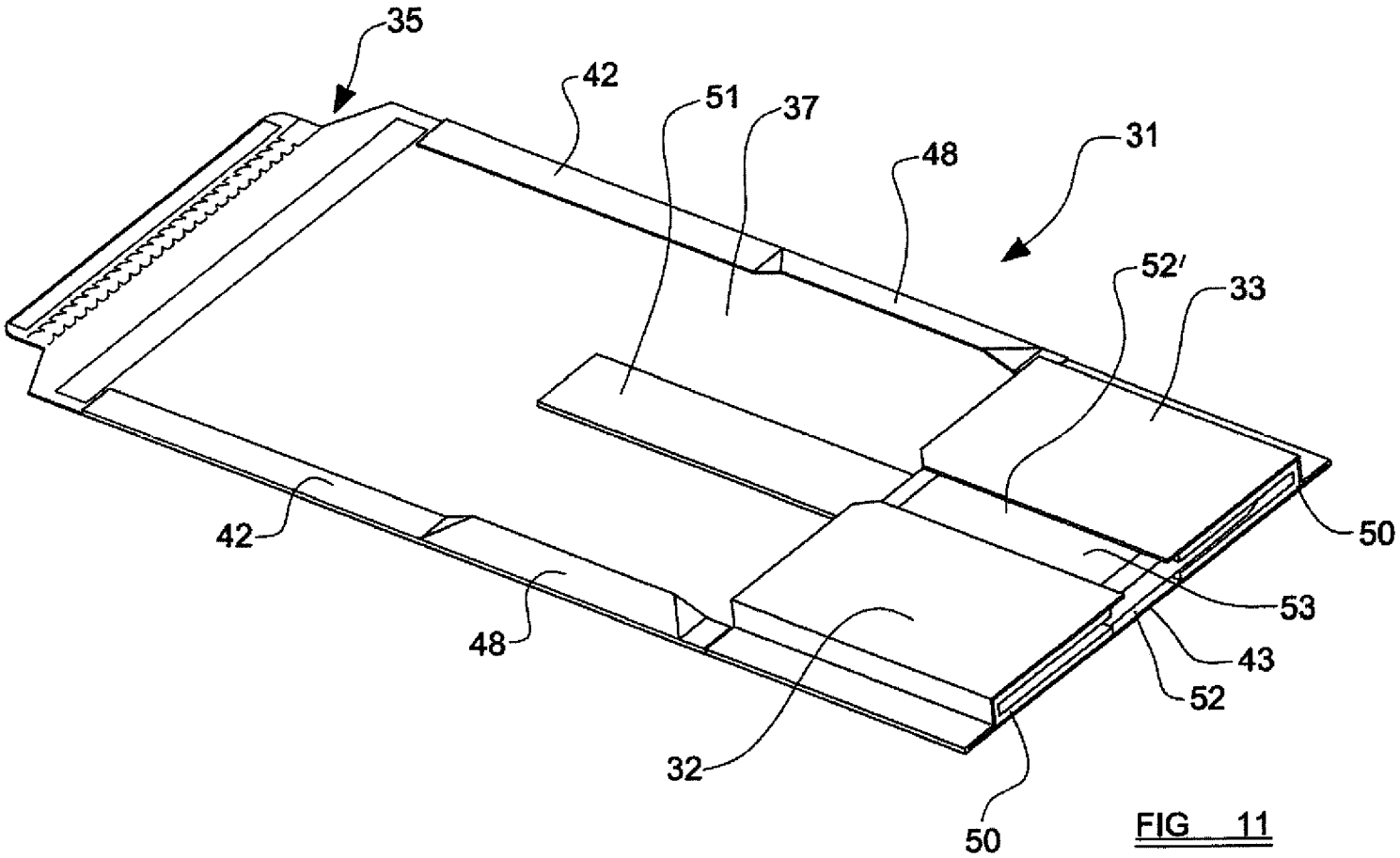
FIGS. 11 and 12 are perspective views of the wrap around container of FIG. 9 in various stages of being wrapped around the tablet PC.
Figure 12:
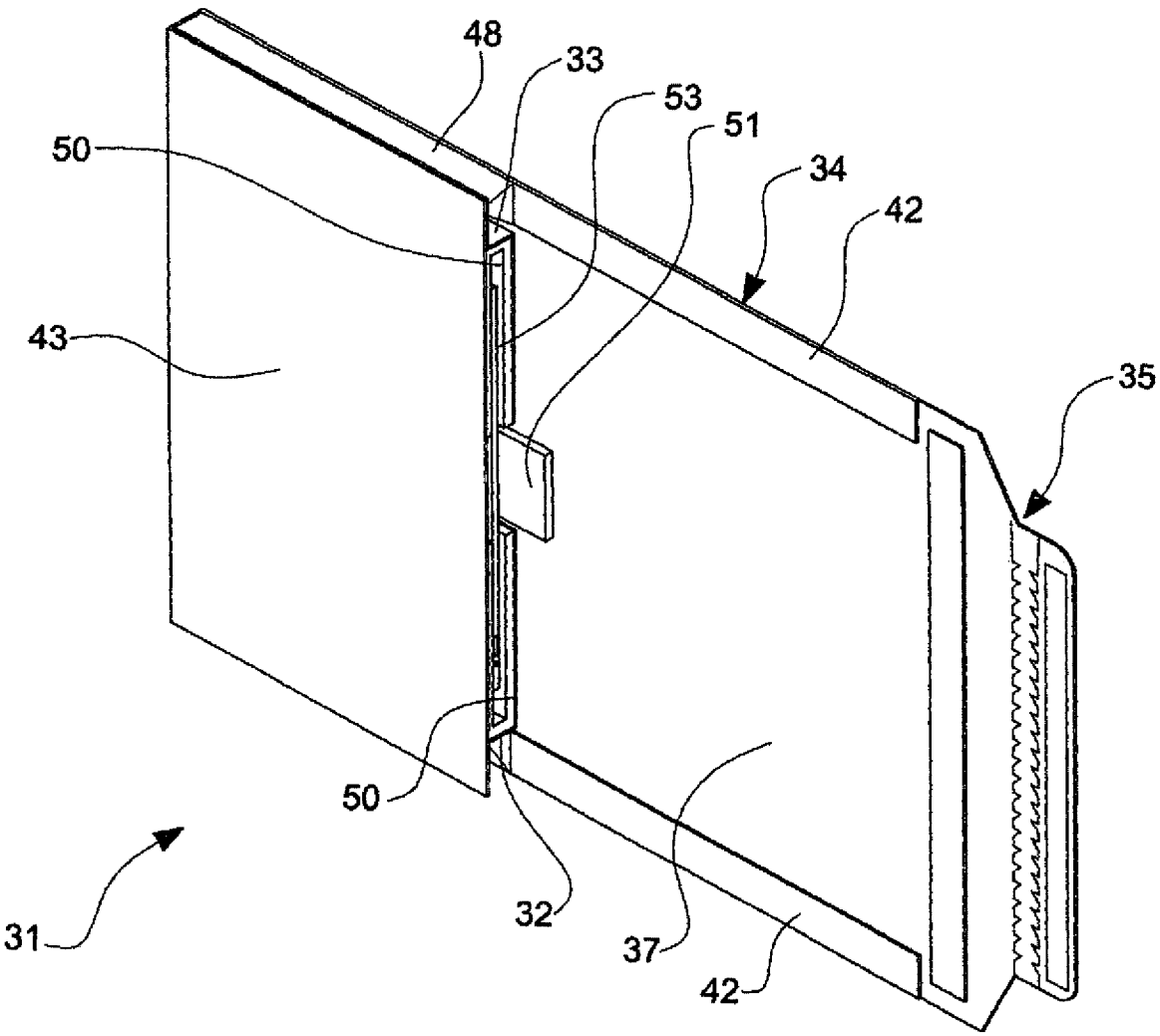
Figure 13:
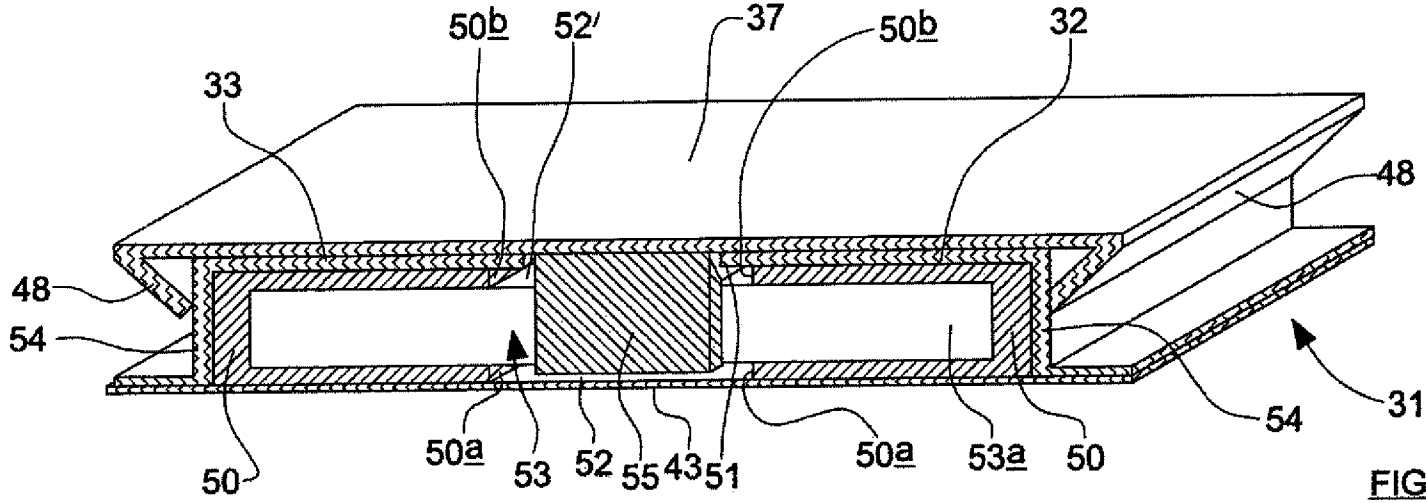
FIG. 13 is a sectional perspective view of the container of FIG. 9 wrapped around the tablet PC.

A tablet PC 53 is placed on the device receiving portion 43 (see FIG. 10) and rests on the end portion of each foam member 50 that is adjacent the first gap 52. The two flaps 32, 33 are folded towards each other over the tablet PC 53 so that the foam member 50 for each flap is adjacent an upper surface of the tablet PC 53 (see FIG. 11), there being a second gap 52' between facing distal ends 50*b* (see FIG. 13) of the flaps. The wrap around portion 37 is folded over the folded flaps 32, 33 which are now in a closed position (see FIGS. 12 and 13) and there is a locking crease 48 on the outside of a side portion 54 of each folded flap 32, 33. The foam strip 51 on the surface of the wrap around portion 37 facing the device receiving portion 43 fits within the second gap 52' between the two foam members 50.

The wrap around portion 37 is then folded underneath the device receiving portion 43. The fixing portion 35 is placed over an outer surface of the wrap around portion 37 above the folded flaps 32, 33 with the fixing flap 40 and the tapered portion 36 being fixed to the wrap around portion 37 by adhesive which has been exposed by removing the respective self-adhesive sealing strips 38, 39 to close the container 31.

The locking creases 48 form protrusions on the wrap around portion 37. The locking creases 48 provide additional strength to the folded flaps 32, 33 adding extra protection to the closed container 31 from side impact. Since the locking creases 48 prevent the sides 54 of the folded flaps 32, 33 from moving outwards this prevents movement of the device inside the closed container 31. Each locking crease 48 may cover three quarters of the side 54 of the respective folded flap 32, 33.

Also, the locking creases 48 prevent someone from trying to remove a device from a closed container without it appearing that the closed container has been tampered with. Known wrap around containers, such as that described in GB 2441997, can have a side portion of a folded flap cut along one edge enabling the device inside to be removed and the cut side portion can then be pushed back to make it look like the container has not been tampered with. To do this with the closed container 31, the locking crease 48 would need to be cut as well which would provide evidence that the closed container 31 has been tampered with.

When the container 31 is closed, opposite end portions 55 (see FIG. 13) of the foam strip 51 protect opposite sides 53*a* of the tablet PC 53 and provides a foam barrier with the part of the wrap around portion 37 adjacent the opposite sides 53*a*.

Figure 14:
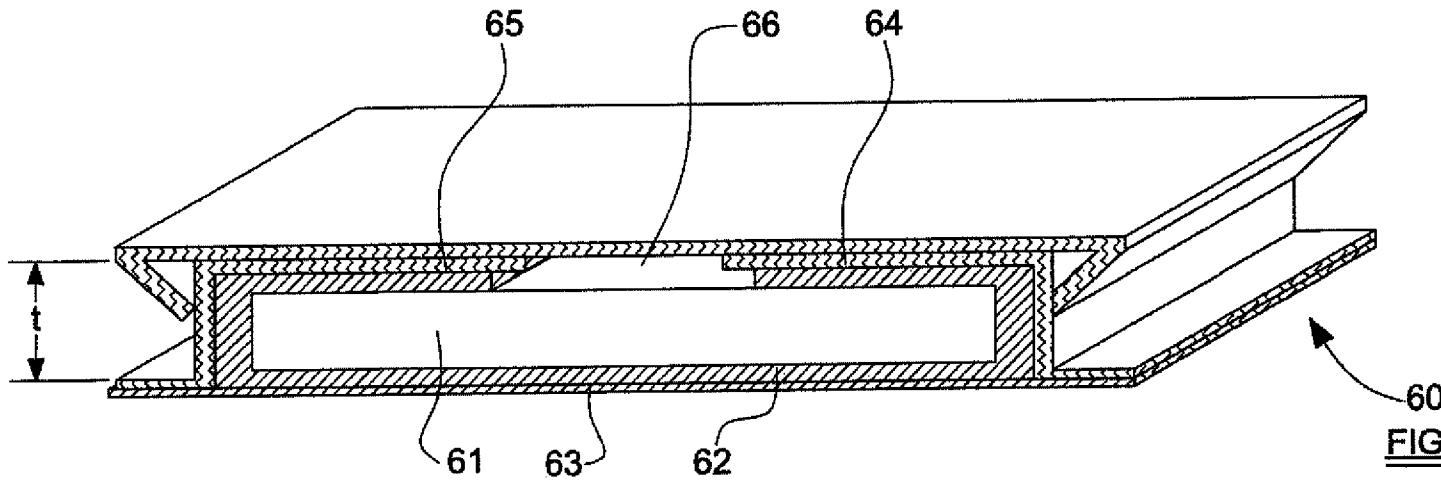
FIG. 14 is a sectional perspective view of a modified container wrapped around a smart phone.

Referring to FIG. 14, another modified wrap around container 60 is shown wrapped around a smart phone 61. It is similar to the wrap around container 31 illustrated in FIGS. 6 to 13 but it does not have a foam strip 51. Also, instead of having two foam members 50, there is a single foam member 62 that extends over the device receiving portion 63 and onto the surface of each flap 64, 65 facing the device receiving portion 63 when in the closed position. In a specific example of a preferred embodiment, when the wrap around container 60 is secured around a device, the closed flaps 64, 65 would be a height t of about 13 mm above the device receiving portion 63. This height is suitable for all mobile phones. In a modification, there may be no gap 66 between the facing distal ends of the closed flaps and/or foam member.

Figure 15:
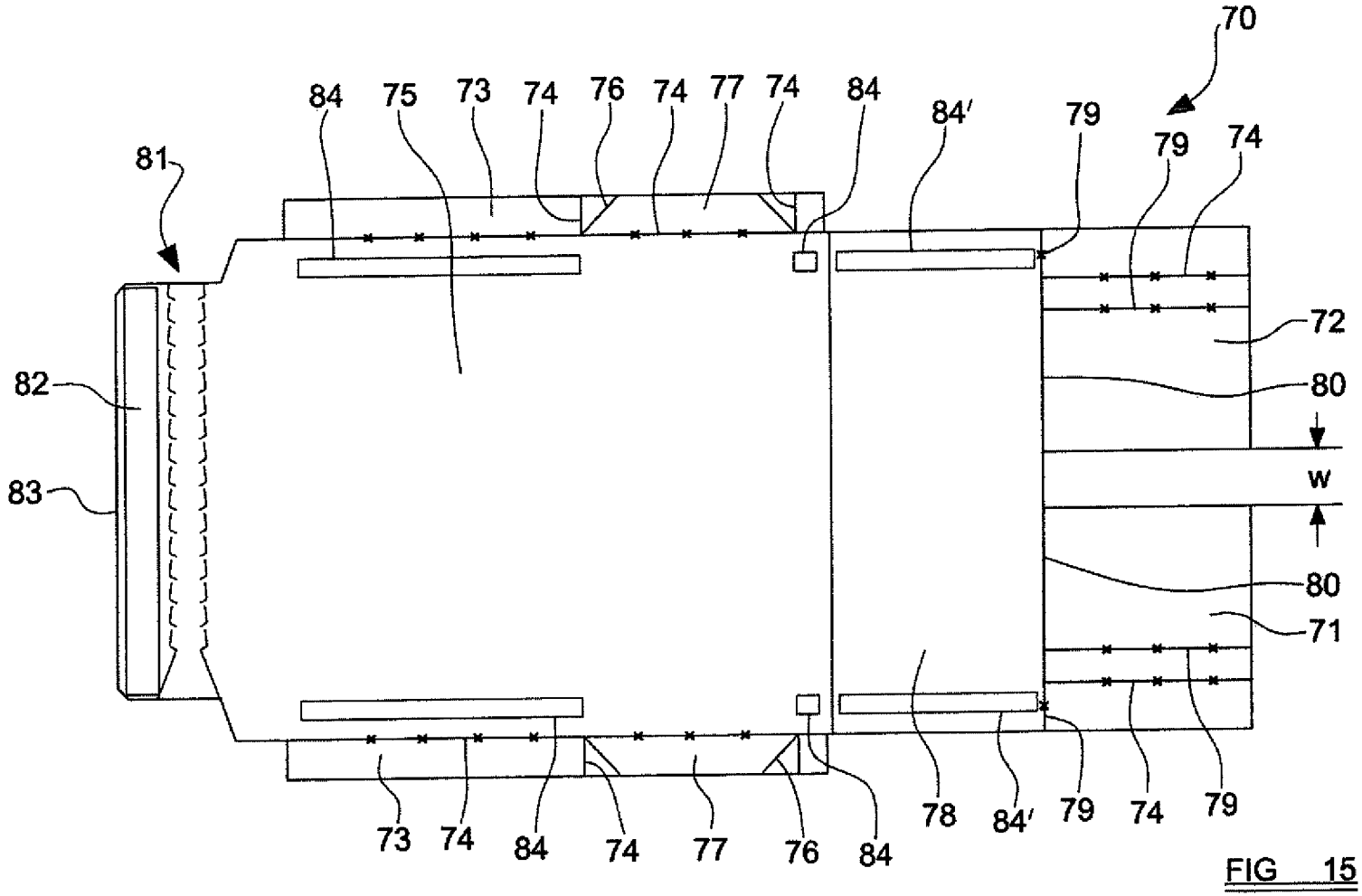
FIG. 15 is a plan view of a specific example of a blank for a wrap around container.

Referring to FIG. 15, a specific example of a preferred embodiment of a blank 70 for forming part of a wrap around container has a gap w of 35 mm between the flaps 71, 72. This is particularly suitable for a wrap around container for a tablet PC. The longitudinal strips 73 have an 8 bar crease 74 with the wrap around portion 75. The diagonal creases 76 of each locking crease 77 have an 8 bar crease 74 and opposite ends of the locking crease 77 have an 8 bar crease 74. Each flap 71, 72 has an 8 bar crease 74 with the flap end portion to be glued to the device receiving portion 78. Where each flap 71, 72 is to be folded from being beside a device to being on top of the device, this fold would have a normal crease 79. Where each flap 71, 72 is connected to the device receiving portion 78, the fold here would have a normal crease 79. The remainder of each flap 71, 72 is perforated cut 80 from the device receiving portion 78. The fixing portion 81 is shown as having a single self-adhesive sealing strip 82 on the fixing flap 83 only. Glue or adhesive 84 is shown to be on the same places as on the blank 30 illustrated in FIG. 6 except that there is glue 84' on the device receiving portion 78 instead of on the end portions of the flaps.

Whilst particular embodiments have been described, it will be understood that various modifications may be made without departing from the scope of the invention.

I claim:

1. A wrap around container for holding an electronic device, the container comprising:

a substantially rectangular panel including a device receiving portion at one end of the panel, a fixing portion at the opposite end of the panel, and a wrap around portion in between;

a pair of flaps extending from opposite sides of the device receiving portion of the panel, each side being on a respective longitudinal edge of the rectangular panel, and each flap being arranged to be folded into a closed position where the flap is over at least a part of the device receiving portion and an upper surface of a device when placed on the device receiving portion, the wrap around portion being arranged to wrap at least over the flaps in the closed position and under the device receiving portion and the fixing portion being arranged to be fixed to an outside of the container above the flaps in the closed position after wrapping of the wrap around portion to close the container; and a foam member extending over at least part of the device receiving portion and onto the surface of each flap facing the device receiving portion when in the closed position so as to form a foam barrier between a device placed on the device receiving portion and the device receiving portion and the closed flaps, the foam member being attached to the device receiving portion and/or at least one of the two flaps, the foam member being configured to be peelable away from the container when the container is open, wherein the foam member comprises a single foam member that extends over the device receiving portion and onto the surface of each flap facing the device receiving portion when in the closed position.

2. The wrap around container as claimed in claim 1, wherein the foam member is attached to the container by double sided tape.

3. The wrap around container as claimed in claim 1, wherein the foam member is attached to the container by adhesive.

4. The wrap around container as claimed in claim 1, including a gap between facing distal ends of the foam members on the surface of the flaps facing the device receiving portion when in the closed position.

5. The wrap around container as claimed in claim 4, wherein the foam member includes a foam strip that extends longitudinally over part of the surface of the wrap around portion facing the device receiving portion when folded over the flaps in the closed position, the foam strip being positioned to fit within the gap.

6. The wrap around container as claimed in claim 5, wherein the foam strip extends in a longitudinal plane to form a further foam barrier, the further foam barrier being between opposite sides of a device held in the container and the wrap around portion when the container is closed.

7. The wrap around container as claimed in claim 1, wherein the foam member comprises a closed cell foam.

8. The wrap around container as claimed in claim 1, wherein the foam member comprises an olefinic polymer.

9. The wrap around container as claimed in claim 8, wherein the foam member comprises a polyethylene foam.

10. The wrap around container as claimed in claim 1, wherein the fixing portion comprises a flap arranged to be fixed to the outside of the container after wrapping of the wrap around portion to close the container and a severable strip between the fixing portion flap and the wrap around portion.

11. The wrap around container as claimed in claim 1 wherein the foam member is attached to the container by double sided tape.

12. The wrap around container as claimed in claim 1 wherein the foam member is attached to the container by adhesive.

* * * * *